US010228143B2

(12) United States Patent
Turchi et al.

(10) Patent No.: US 10,228,143 B2
(45) Date of Patent: Mar. 12, 2019

(54) GAS BURNER, GAS HOB AND GAS COOKING APPLIANCE

(71) Applicant: Electrolux Appliances Aktiebolag, Stockholm (SE)

(72) Inventors: Marco Turchi, Forli (IT); Fabio Rasi, Forli (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 367 days.

(21) Appl. No.: 15/025,350

(22) PCT Filed: Sep. 18, 2014

(86) PCT No.: PCT/EP2014/069938
§ 371 (c)(1),
(2) Date: Mar. 28, 2016

(87) PCT Pub. No.: WO2015/078605
PCT Pub. Date: Jun. 4, 2015

(65) Prior Publication Data

US 2016/0238256 A1 Aug. 18, 2016

(30) Foreign Application Priority Data

Nov. 26, 2013 (EP) ..... 13194344

(51) Int. Cl.
*F24C 3/00* (2006.01)
*F24C 3/08* (2006.01)
(Continued)

(52) U.S. Cl.
CPC ..... *F24C 3/082* (2013.01); *F23D 14/06* (2013.01); *F23D 14/58* (2013.01); *F23D 14/62* (2013.01);
(Continued)

(58) Field of Classification Search
CPC ..... F23D 14/06; F23D 14/58
See application file for complete search history.

(56) References Cited

U.S. PATENT DOCUMENTS 5,492,469 A * 2/1996 Oda ..... F23D 14/06 431/263
2010/0000515 A1 1/2010 Tomaselli et al.
(Continued)

FOREIGN PATENT DOCUMENTS

AT 303312 B 11/1972
CN 101512226 A 8/2009
(Continued)

OTHER PUBLICATIONS

Office action and Search Report issued in counterpart China application No. 201480060645.2 dated Jun. 2, 2017; 18 pages (with translation).
(Continued)

*Primary Examiner* — Jason Lau
(74) *Attorney, Agent, or Firm* — Pearne & Gordon LLP

(57) ABSTRACT

A gas burner for a gas hob of a gas cooking appliance. The gas burner comprises a gas crown (1) and a cap (14) configured for covering the gas crown (1), wherein the gas crown (1) comprises a central gas distribution chamber (5) confined by a circumferential wall (4) which comprises a peripheral outer surface inclined downwards to the outside, and a plurality of gas outlet ports (6) implemented in the circumferential wall (4) as upwardly opened grooves passing through the circumferential wall (4) and opening into the slanted outer surface, wherein lower outer edges of the grooves (6) are sloped towards the gas distribution chamber (5) and define a groove perimeter (12) corresponding to or larger than the outer cap perimeter (13).

8 Claims, 7 Drawing Sheets

(51) Int. Cl.

| | |
|---|---|
| ***F23D 14/06*** | (2006.01) |
| ***F23D 14/58*** | (2006.01) |
| ***F23D 14/62*** | (2006.01) |
| ***F23D 14/70*** | (2006.01) |

(52) U.S. Cl.
CPC ..... *F23D 14/70* (2013.01); *F24C 3/08* (2013.01); *F23D 2900/14062* (2013.01)

(56) References Cited

U.S. PATENT DOCUMENTS

| | | | |
|---|---|---|---|
| 2010/0186730 | A1 | 7/2010 | Cadeau et al. |
| 2012/0090595 | A1 | 4/2012 | Shaffer |

FOREIGN PATENT DOCUMENTS

| | | | |
|---|---|---|---|
| CN | 101520181 | A | 9/2009 |
| CN | 101629720 | A | 1/2010 |
| CN | 102893088 | A | 1/2013 |
| FR | 1190211 | A | 10/1959 |
| GB | 1521481 | A | 8/1978 |
| JP | 2001050512 | A | 2/2001 |
| KR | 20090064605 | A | 6/2009 |
| WO | 2004111537 | A1 | 12/2004 |

OTHER PUBLICATIONS

International Search Report issued in PCT/EP2014/069938 dated Dec. 4, 2014, 3 pages.

* cited by examiner

GAS BURNER, GAS HOB AND GAS COOKING APPLIANCE

The present invention is related to a gas burner, a gas hob and a gas cooking appliance.

Gas hobs are known in many different geometrical configurations. In particular different shapes of gas crowns and respective caps have been proposed, in particular with the aim of improving flame shapes and burner efficiency. However, despite of the multitude of different burner designs, there is still room and need for further improving burner efficiency, while at the same time keeping the manufacturing costs low.

Therefore, it is an object of the invention to provide a gas burner with improved energy efficiency while at the same time keeping the manufacturing costs low. Under similar considerations, a gas hob and gas cooking appliance shall be provided.

This object is solved according to the invention by the features of claims 1, 10 and 11. Embodiments of the invention in particular result from the dependent claims and the specification below.

According to claim 1, a gas burner for a gas hob of a gas cooking appliance is provided. The gas burner in particular may relate to a household gas cooking appliance, yet may also be applied to other types of appliances.

The gas hob comprises a gas crown and a cap configured to cover the gas crown, in particular, the cap is adapted to implement a cover or lid for gas conduction structures, in particular inner gas conduction structures, of the gas crown.

The gas crown, in particular as an inner gas conduction structure, comprises a gas mixing or distribution chamber. The gas distribution chamber may be connected to a gas supply source and distribute gas to single gas outlet ports, in particular flame ports, provided with the gas burner.

The gas distribution chamber is confined inter alia by a circumferential wall. The circumferential wall in particular may constitute a lateral confinement, wherein a bottom wall may constitute a lower confinement of the gas distribution chamber.

The circumferential wall in particular may be integrally designed with the bottom wall. The gas crown, i.e. the bottom wall and circumferential wall as an integral structural component may be manufactured by casting.

The circumferential wall according to the invention comprises a peripheral outer surface which is slanted, i.e. inclined. The direction of the slanting or inclination may be directed downwards to the outside. According to the invention, the inclination or slanting may lie between or range from 20 to 70 degrees relative to the horizontal. Note that the term "horizontal" in particular shall relate to the ordinary operational orientation or alignment of the gas burner.

This in particular may mean that the peripheral outer surface, i.e. a lateral outer wall of the gas crown, slopes or falls off from an upper edge of the crown towards the bottom of the crown.

In case that the crown has a rotationally symmetrical shape, the outer dimensions of the crown in particular may have a truncated cone shape. However, it shall be mentioned that the crown in cross sections in parallel to the bottom wall may be of other geometry, in particular oval, angular and the like.

The circumferential wall according to the present invention comprises a plurality of gas outlet ports implemented in the circumferential wall as upwardly opened grooves.

The grooves pass through the circumferential wall and open into the slanted outer surface, i.e. lateral surface.

The grooves in particular may be implemented as indentations or notches at an upper end face of the gas crown.

According to the invention, the groove base in particular may have an inclination angle ranging from or lying between 10 to 30 degrees relative to the horizontal towards the gas distribution chamber.

In particular, the cap may comprise a section implemented for covering the grooves from above such that gas outlet ports or channels are formed by the crown grooves and cap section.

According to the invention, the lower outer edges of the grooves define a groove perimeter corresponding to or matching with the outer cap perimeter, and/or being larger than the outer cap perimeter.

This in particular may mean that the outer lower edges of the grooves are drawn out or are extended in directions lateral, i.e. perpendicular, to the circumferential wall, such that their outer, lower ends essentially fit with or protrude over the outer perimeter of the cap covering the crown. It shall be noted, that obtaining the proposed relationship, the cap and the grooves may be adapted accordingly, i.e. the outer cap perimeter of the cap and the grooves, i.e. the groove perimeter, may be customized to match to each other as proposed.

Implementing the grooves in such a way that the lower edges of the grooves are pulled or pushed out, and preferably match or exceed the outer perimeter of the cap in combination with the slanted circumferential wall has shown to provide improved burner efficiency. In particular, the burner power can be optimally impinged to a pan or pot placed on the gas burner.

The sloped circumferential wall in particular constitutes a type of mirror or reflector for heat in a direction from the bottom towards the cooking face of the gas burner. This in particular shall mean that the sloped outer wall provides a bottom-up directed heat reflectance, thereby enhancing utilization or exploitation of heat generated by gas burnt at the gas outlet ports, i.e. the grooves, or flame ports.

The shape of the grooves also contributes to the energy efficiency, as pulling out the lower edges of the grooves contributes to forcing the generated thermal energy upwards to the cooking face of the gas burner.

In all, the combination of sloped lateral surfaces and the special geometry of the grooves greatly contribute to force or guide the emerging heat upwards, towards the heating face, where pots, pans and the like may be placed. Hence, improved energy efficiency can be obtained.

In embodiments of the invention, the outer surface in lateral cross sections of the circumferential wall may have a homogenous, linear shape or inclination. This in particular shall mean that the surface is free from bucklings or kinks, in particular, that the surface is implemented with a single inclination angle.

Such surfaces have adequate mirror effects, in particular for reflecting heat upwards to the cooking face. Besides this, gas crowns with such configurations can be manufactured in a comparatively easy way, such for as example by casting.

As mentioned above, the inclination or tilt angle of the outer circumferential surface may lie between 20 and 70 degrees relative to the horizontal. This in particular shall mean that the outer or peripheral surface of the circumferential wall is tilted between 20 to 70 degrees to the horizontal. Such tilt angles have been proven advantageous in connection with the proposed geometry of the gas grooves in order to direct as much heat as possible upwards towards the cooking face.

As already mentioned, the groove bases of the grooves may be inclined downwards towards the gas distribution chamber. Or, in other words, the groove bases may be inclined upwards in a direction from the gas distribution chamber to the outside, which in particular corresponds to the direction of the gas flow through the gas grooves during operation of the gas burner.

In case that the crown has a circular shape, the grooves may be implemented as upwardly opened incisions or indentations running radially outwards, i.e. from the gas distribution chamber towards the outer side of the gas burner. In particular in this configuration, the groove bases may be inclined radially upwards.

Respective inclinations of the groove bases may contribute to a more vertical orientation of the gas flames generated during operation of the gas burner. This, in particular in combination with the sloped outer surface, may greatly contribute to enhanced energy efficiency of the gas burner.

Note that improvements in energy efficiency as compared to known gas burner designs may be as large as 5%.

According to the invention, the groove base inclination angle may lie between 10 and 30 degrees relative to the horizontal.

Such inclination angles have been shown advantageous in particular for the slope angles of the outer surface as mentioned further above. Further respective groove base inclination angles are favourable for the proposed groove and cap geometry or designs with matching outer perimeters.

In embodiments of the invention, the groove width in a direction perpendicular to its groove base increases. This in particular shall mean that the groove width may increase from the groove base towards the upper end of the groove.

In particular in this case, the lateral or vertical walls of the grooves, i.e. defining the grooves, may be tilted relative to the vertical by a tilt angle lying between 4 and 5 degrees, in particular by a tilt angle of 4.4 degrees. Such tilted groove walls in particular may be of advantage for manufacturing the crown, in particular via casting. However, increasing groove widths may also contribute to enhanced flame shapes in the end leading to improved energy efficiency of the gas burner.

In embodiments, the side of the cap facing the crown in the assembled state may consist of at least one even or level surface area. The surface area in particular may be implemented or adapted to cover the grooves at an upper end or face side of the burner crown. The terms even or level in these embodiments in particular shall mean that the respective surface area is free from inclined or bevelled sections. Using such even or level areas or surfaces may contribute to simplified manufacture of the gas burner components. However, respective even or level surfaces may also contribute to enhanced gas flow through the gas grooves or gas outlet ports.

In embodiments the cap may comprise at the side facing the crown in the assembled state two even or level surface areas, wherein the first outer level surface area in the assembled state covers the gas grooves, and the second level surface area covers the gas distribution chamber.

The first and second level surface areas may be stepped relative to each other, wherein a stepped edge between the first and second surface area may be adapted to face or abut an upper, inner perimeter of the circumferential wall in the assembled state. This in particular may mean that a stepped edge existing between the first and second level surface areas may be used as a positioning edge for correctly positioning or fitting the cap onto the gas crown. In case of a ring-shaped circumferential wall, the first level surface area may be shaped as a ring, and the second level surface area may have a circular shape.

In embodiments, the crown may have the shape of a truncated cone. Such a shape in particular may lead to reduces manufacturing costs. In case of a truncated cone type crown, the distribution chamber may be circular and the circumferential wall may be shaped as a ring. In particular in this configuration, the cap in variants may comprise a ring-shaped first level surface area and a circular shaped second level surface area, as mentioned above.

According to claim 6, a gas hob is provided comprising at least one gas burner according to any embodiment and variant of the invention as described above.

According to claim 7, a gas cooking appliance is provided which comprises a gas hob as mentioned beforehand, in particular at least one gas burner according to the invention and described further above.

As to advantages and advantageous effects of the gas hob and gas cooking appliance, reference is made to the description relating to the gas burner as such.

In all it shall become clear, that the proposed gas burner has improved energy efficiency, and at the same time can be manufactured at comparatively low costs.

Exemplary embodiments of the invention will now be described in connection with the annexed figures, in which FIG. 1 shows a perspective view of a first variant of a gas crown;

Figure 1:
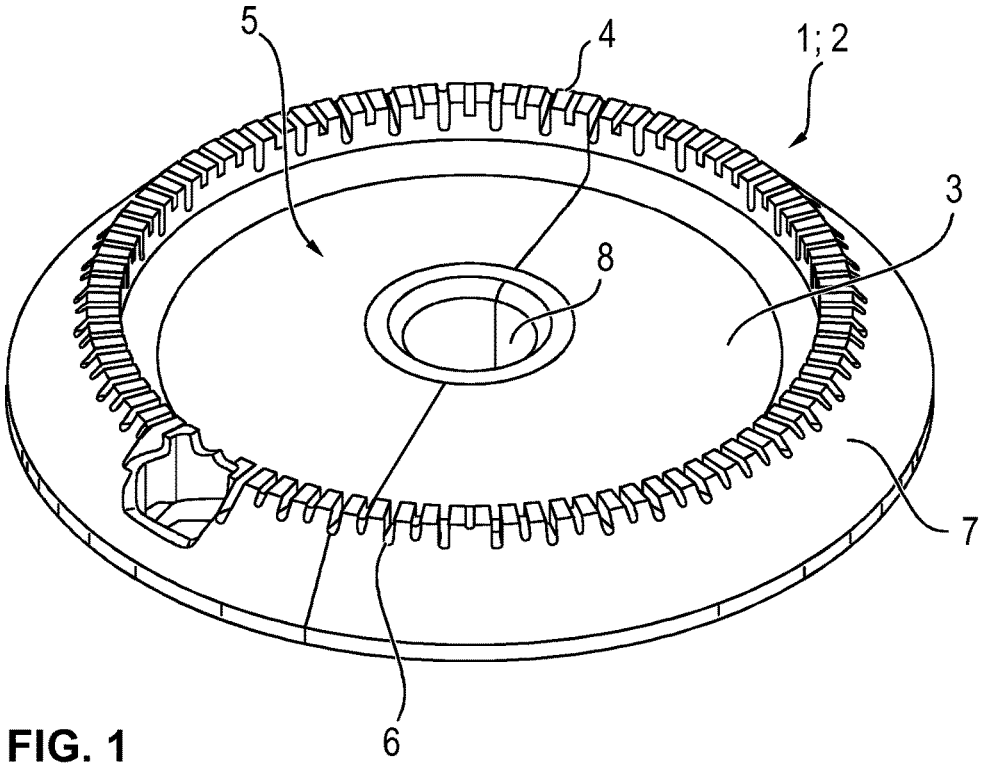

FIG. 1 shows a perspective view of a first variant of a gas crown 1 of a gas burner. The crown 1 in the present case has a truncated cone or frustoconical shaped crown body 2.

The crown 1 comprises a bottom wall 3 and a circumferential wall 4. The bottom wall 3 and the circumferential wall 4 make up a single integral part, and as such essentially make up the crown body 2.

The bottom wall 3 and circumferential wall 4 together define a gas distribution chamber 5. The gas distribution chamber 5 in the present case has a circular base and essentially vertical walls, and hence has a cylindrical shape. The gas distribution chamber 5 is open at the top.

In the circumferential wall 4, there are provided a plurality of upwardly opened grooves 6 passing through the circumferential wall 4 and opening at an outer surface 7 of the crown 1.

Figure 6:
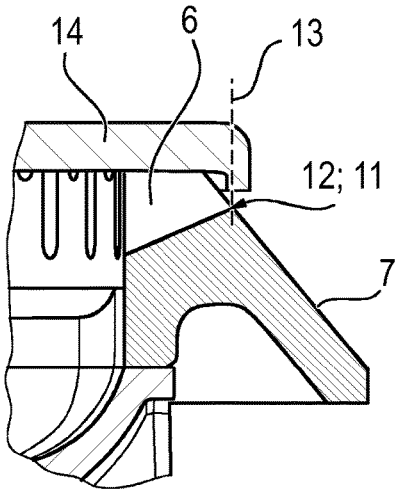
FIG. 6 shows the detail of FIG. 5 together with a burner cap.

During operation, the crown 1 and also the gas grooves 6 are covered by a cap (see FIG. 6), such that the grooves 6 together with the cap define gas outlet ports. Gas which enters during operation via a gas inlet port 8 is distributed in the gas distribution chamber 5 to the grooves 6 and can exit the crown 1 to be burnt at the groves outlet, i.e. at the outlets or openings of the grooves or gas outlet ports.

In the present case, the crown body 2 has a rotationally symmetric shape, and the grooves 6 cut the circumferential wall 4 in radial direction.

It shall be noted, that the upper face of the circumferential wall 4, except for the grooves 6, is even or planar, such that an even or planar cap (see FIG. 6) may be positioned on the crown 1 in order to cover the gas distribution chamber 5 and the grooves 6.

Figure 2:
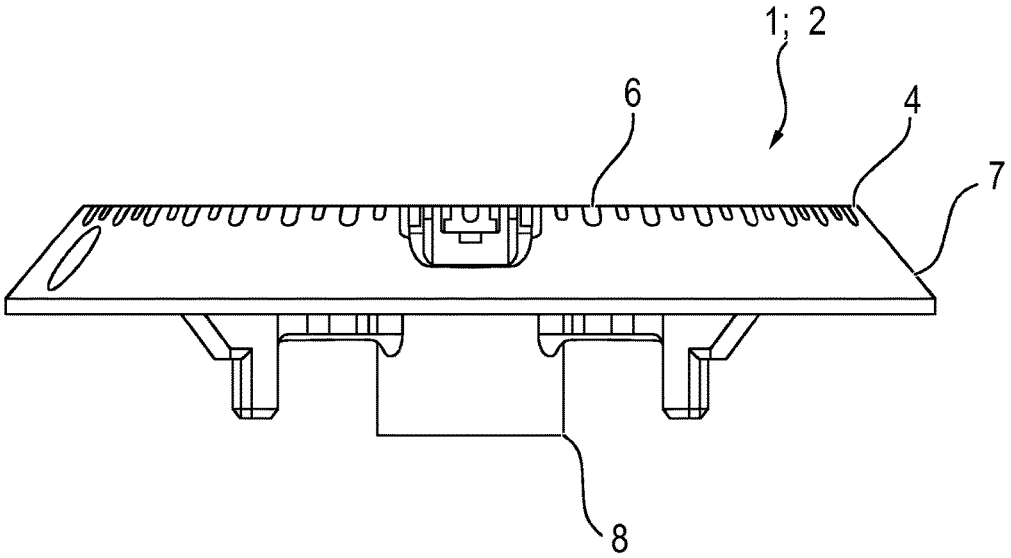
FIG. 2 shows a side view of the gas crown of FIG. 1.

From FIG. 2, which shows a side view of the gas crown 1 of FIG. 1 a further detail of the proposed crown 1 can be seen. The detail relates to the outer surface 7, and it can be seen that the lateral outer surface 7 is inclined downwards relative to a direction radially outwards. The inclination relative to the horizontal may be between 20 and 70 degrees.

Implementing the lateral outer surface 7 as a uniformly inclined, in cross sections linear declining lateral face has the advantage that heat generated at the gas outlet ports i.e. grooves 6, during operation can be efficiently reflected to the top or upwards such that the energy loss can advantageously be reduced in particular as compared to burners with different shaped lateral outer surfaces.

Note that the lateral outer surface 7 is configured to implement a truncated cone envelope, in particular is free from bucklings and kinks.

Figure 3:
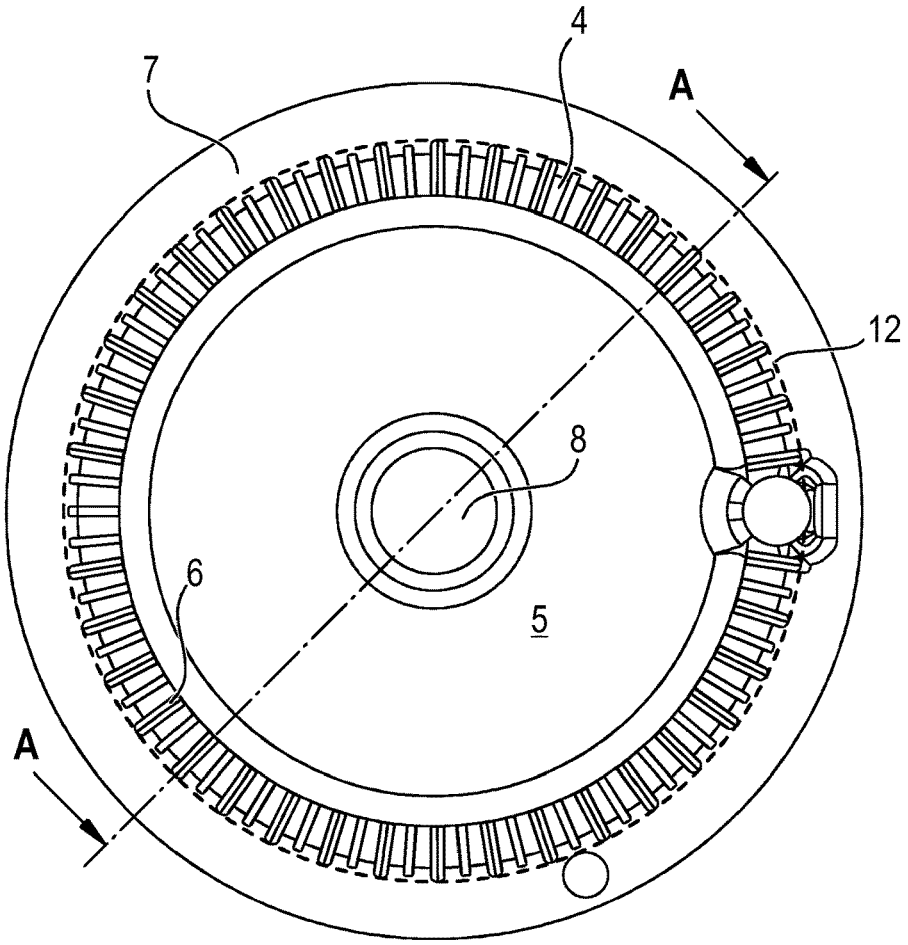
FIG. 3 shows a top view of the gas crown of FIG. 1.

FIG. 3 shows a top view of the gas crown 1 of FIG. 1. From FIG. 3 it can be seen in particular that the grooves 6 pass through or groove the circumferential wall 4 in radial direction.

Figure 4:
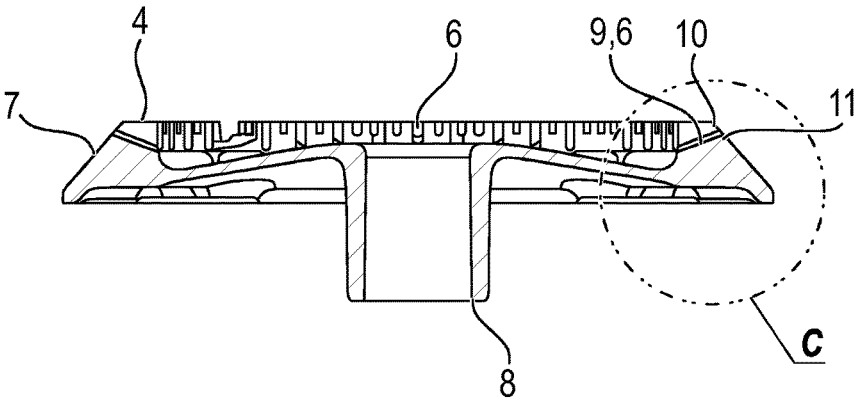
FIG. 4 shows a cross-sectional view of the gas crown along line A-A in FIG. 3.

FIG. 4 shows a cross-sectional view of the gas crown along line A-A in FIG. 3, wherein line A-A passes through a pair of grooves 6 lying on opposite sides of the circumferential wall 4.

Figure 5:
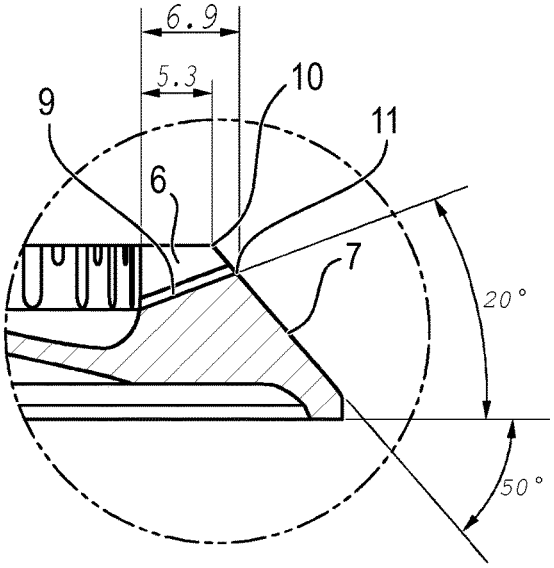
FIG. 5 shows detail C of FIG. 4.

What can be deduced from FIG. 4 and by far better from FIG. 5 showing detail C of FIG. 4, is that the groove bases 9 or groove roots are inclined upwards in a direction radially outwards. Such an inclination may contribute to a more upward or vertical direction of the flames at the output port during operation, which is advantageous for the energy efficiency of the gas burner.

The inclination of the groove bases 9 may lie in the range between 10 and 30 degrees, relative to the horizontal. In the present embodiment shown in FIG. 5, the inclination of the groove bases 9 is about 20 degrees.

In FIG. 5, an exemplary inclination angle of the outer surface 7 is indicated, which is about 50 degrees to the horizontal in this embodiment.

In FIG. 5, two further exemplary dimensions of the grooves 6 are indicated. The given dimensions relate to the radial depth of the grooves in radial direction, i.e. in a direction along the groove bases 9. As can be seen from FIG. 5, the upper outer edges 10 of the grooves 6 lie radially inside of the lower outer edges 11 of the grooves 9. Or in other words, the radial depth (5.3 mm) of the circumferential wall at the level of the upper outer edge 10 is smaller than the radial depth (6.9 mm) at the level of the lower outer edge 11 relative to the radial direction.

In accordance with the present invention, the design of the grooves 6 at the outer surface 7 is such that a groove perimeter 12 defined by the lower outer edges 11 corresponds or matches a cap perimeter 13 of the cap 14 covering the crown 1 during ordinary operation.

In other words, the lower outer edges 11 of the grooves 6, and thereby the flame ports or gas outlet ports of the crown 1, are drawn out to the cap perimeter 13.

In doing so, the heat generated by flames at the gas outlet ports can be more efficiently delivered upwards to the cooking face where pots, pans and the like are positioned during cooking. In particular a more vertical direction of the flames can be obtained as compared to known solutions in which the flame ports are not drawn out.

Drawn out flame ports in particular in combination with the inclined outer surface 7, and the inclined groove bases 9 leads to enhanced burner efficiency, in that heat energy generated by gas flames can be efficiently guided upwards to cookware placed on the gas burner.

Figure 7:
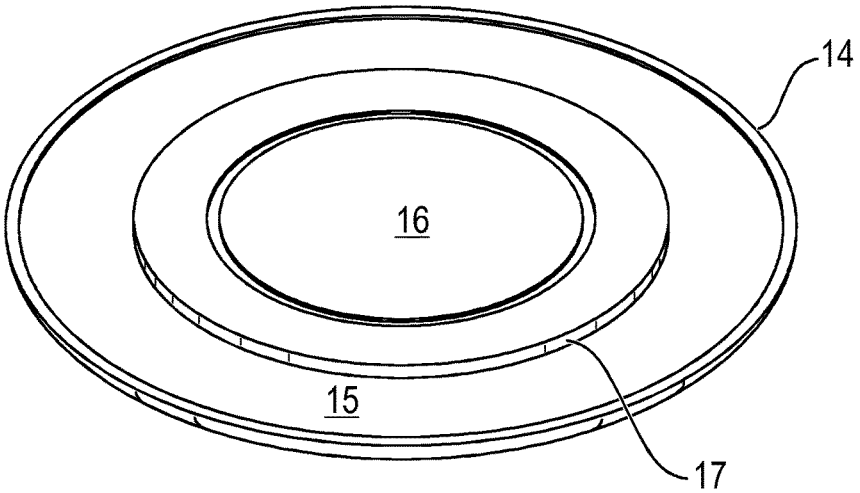
FIG. 7 shows a perspective view of the lower side of a burner cap.
Figure 8:
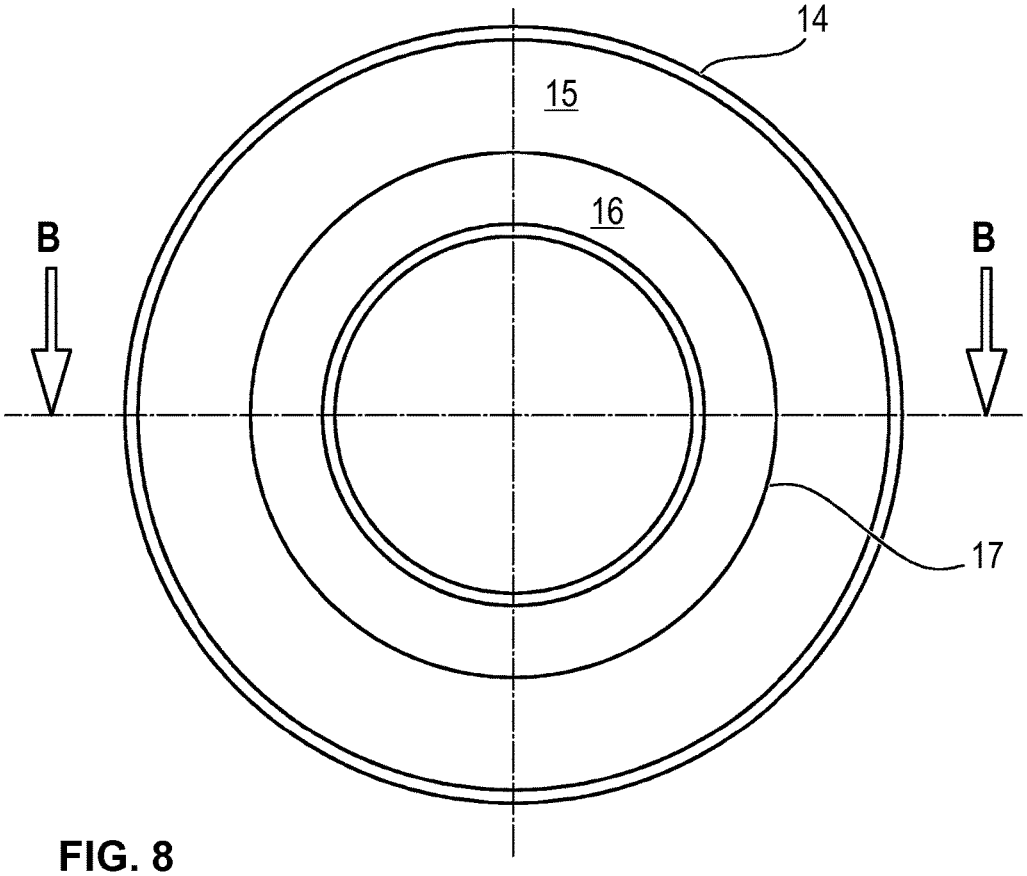
FIG. 8 shows a top view of the cap.
Figure 9:
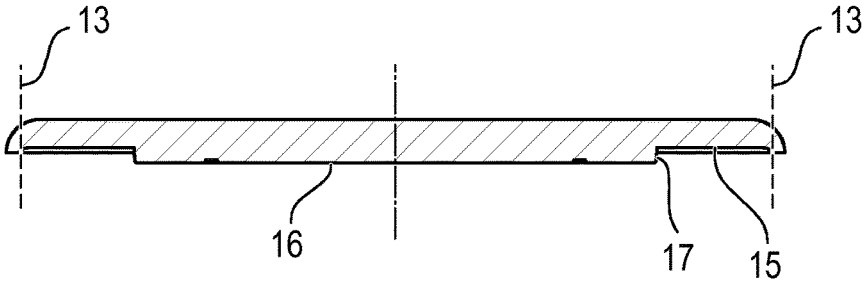
FIG. 9 shows a cross-sectional view of the cap along line B-B in FIG. 8.

FIG. 7 shows a perspective view of the lower side of the burner cap 14; FIG. 8 shows a top view of the cap 14; and FIG. 9 shows a cross-sectional view of the cap along line B-B in FIG. 8. As can be seen from a combination of FIG. 7 to FIG. 9, the lower side of the cap 14 comprises a first even, i.e. level, surface area 15 and a second level surface area 16. Level or even in particular shall mean that respective surface areas are planar or flat.

The first and second level surface areas 15, 16 are stepped relative to each other, which in the present embodiment is implemented by different cap thicknesses. The cap thickness in the region of the second level surface area 16 is thicker than the region of the first level surface area 15. The second level surface area 16 is designed such that it can cover the gas distribution chamber 5 and that a stepped edge 17 between the first and second level surface area 15 and 16 in the assembled state faces or abuts an inner perimeter of the gas distribution chamber 5, in particular circumferential wall 4. In the assembled state, the first level surface area 15 covers the grooves 6 to make up the gas outlet ports or flame ports.

In the present example, the upper outer edge of the cap 14 is rounded off, which may mean that the outer perimeter of the cap 14 slightly moves inward (see for example FIG. 9).

The stepped edge 17 may act as a positioning guide for the cap 14, and also provides some retaining functions preventing the cap 14 from slipping off the crown 1 during ordinary use.

As the cap 14 comprises as much as possible even, i.e. level or flat, surfaces, the cap 14 can be manufactured at comparatively low costs. Note, due to the fact that the upper face of the circumferential wall 4 also is essentially flat and that the gas outlet or flame ports are implemented as radial grooves covered by the cap, the gas burner, comprising cap 14 and crown 1, can be manufactured at comparatively low costs, and, as has been discussed, has improved energy efficiency.

Figure 10:
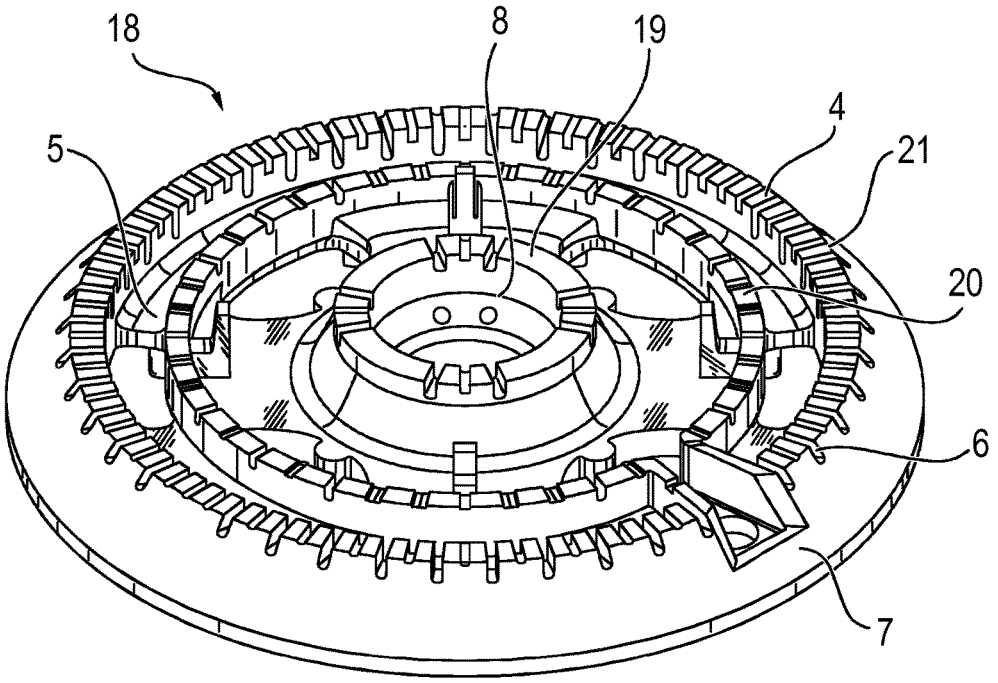
FIG. 10 shows a perspective view of a second variant of a gas crown.

FIG. 10 shows a perspective view of a second variant of a gas crown, which is referred to as further crown 18. The difference to the crown 1 shown in FIG. 1 is that the further crown 18 is implemented as a triple crown, with an inner first crown 19, a second middle crown 20 and an outer third crown 21.

Regarding the outer third crown 21, this third crown 21 is designed and implemented essentially like the crown 1 of the first variant, shown in particular in FIG. 1. Hence, the same reference signs are used. The description relating to the grooves 6, groove bases 9, their inclination, the outer surface 7 and its inclination, as well as the design of the upper outer edges 10 and lower outer edges 11 of the grooves 6 and the like apply mutatis mutandis. A separate description is omitted and it is referred to the description related to FIG. 1 through FIG. 9.

Figure 11:
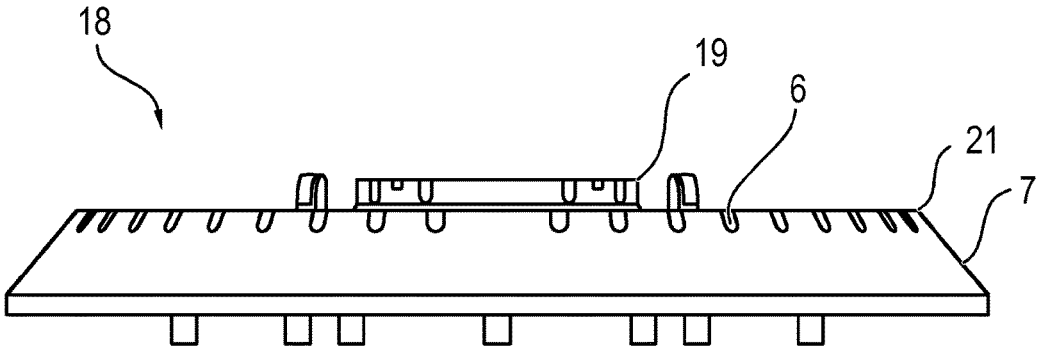
FIG. 11 shows a side view of the gas crown of FIG. 10.

FIG. 11 shows a side view of the further gas crown 18. As can be seen, the inner first crown 19 protrudes, relative to the vertical, over the outer third crown 21. The inner first crown 19, i.e. the grooves, lateral wall and the like, does/do not implement all the features related to the invention described herein. In particular, the outer surface of the inner first crown 19 is running vertically, i.e. is not inclined. This resembles a conventional design. However, it shall be mentioned, that the inner first crown 19 may be designed and implemented in accordance to the outer third crown 21 or the crown 1 as described in connection with FIGS. 1 to 9, i.e. in accordance with the invention as proposed herein.

Figure 12:
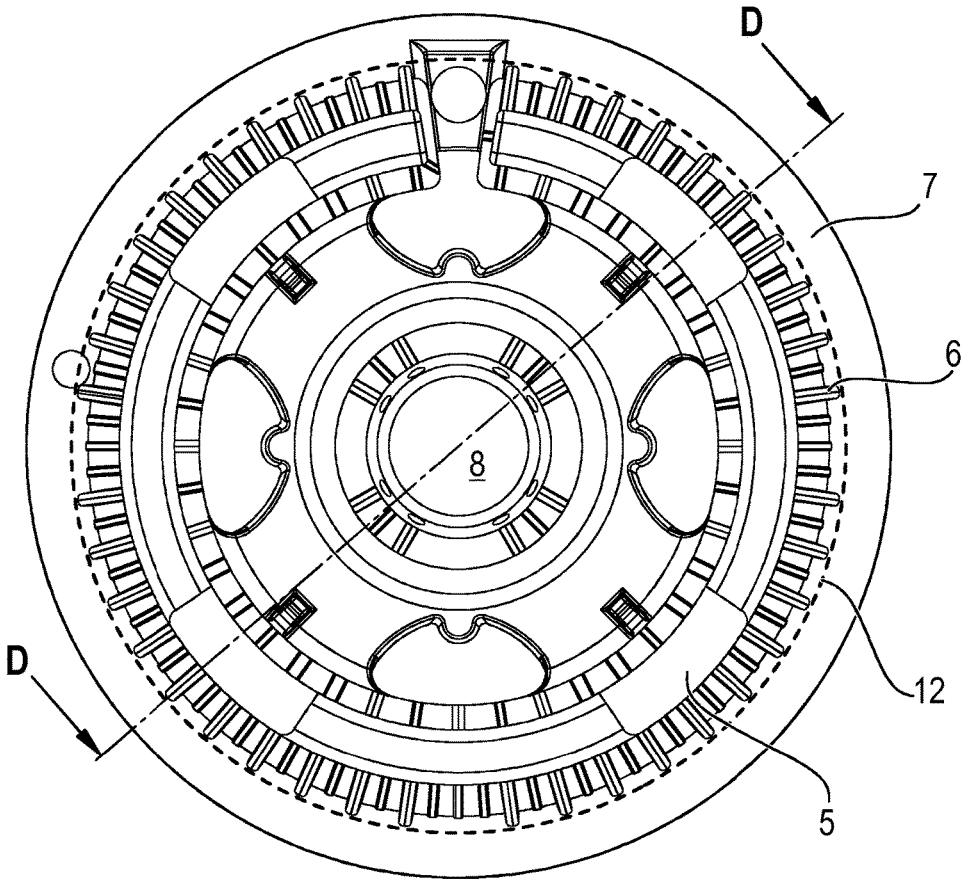
FIG. 12 shows a top view of the gas crown of FIG. 10.
Figure 13:
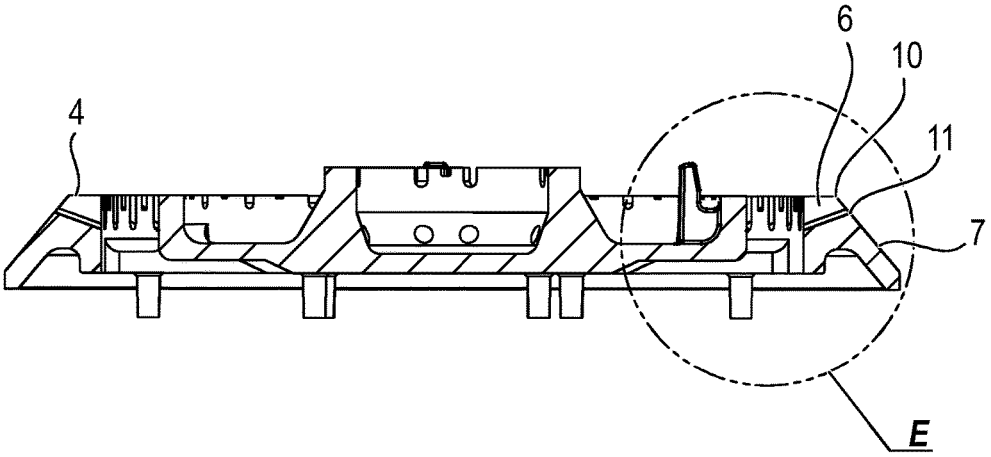
FIG. 13 shows a cross-sectional view of the gas crown of FIG. 9 along line D-D in FIG. 12.
Figure 14:
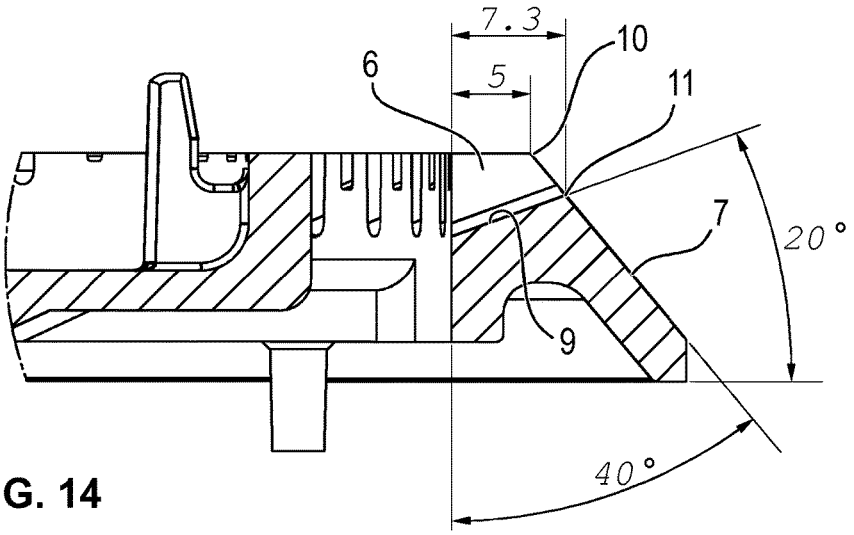
FIG. 14 shows detail E of FIG. 13.

FIG. 12 to FIG. 14 show further details of the further crown 18, which details essentially relate to the design and construction of the outer third crown 21. From FIG. 12 to FIG. 14 it can be seen, that the grooves 6 and outer surface 7 of the outer third crown 21 are implemented in accordance with the crown in FIG. 1.

In particular, the lower outer edges 11 define a groove perimeter 12 (see FIG. 12), wherein this groove perimeter 12 matches with or corresponds to the cap perimeter 13, i.e. the outer cap perimeter 13. This in particular can also be seen from FIG. 15 showing a side view of a gas burner in the second variant.

Figure 15:
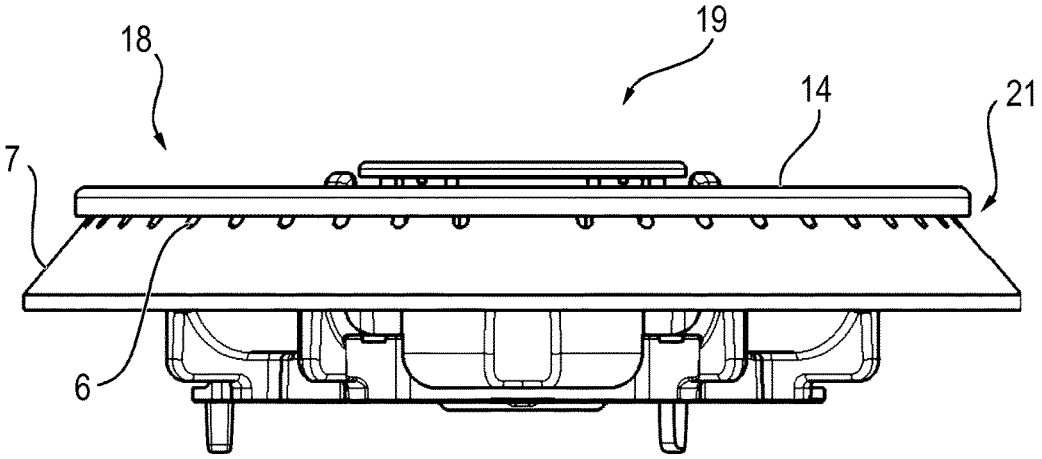
FIG. 15 shows a side view of a gas burner in the second variant.

From FIG. 15 it can be seen that the inner first crown 19 is also covered by a cap; but the grooves are not designed and implemented such that the lower outer edges of the grooves are drawn out to the outer perimeter of the cap.

From FIG. 14 exemplary groove dimensions are indicated, wherein the depth of the upper side of the grooves 6 in radial direction at the level of the upper outer edges 10 is about 7.3 mm, and a radial depth at the level of the lower outer edges 11 of the grooves 6 is about 5 mm. The inclination angles of the groove bases 9 and outer surface 7 in the present example are 20 and 40 degrees, respectively.

As becomes clear, the gas burner of second variant (see FIG. 15) also provides improved energy efficiency, in particular as the outer third crown 21 is implemented in accordance with the crown as shown and described in FIGS. 1 to 9, in particular corresponding to a favourable embodiment of the invention described herein.

As can be seen, the invention as proposed herein is able to provide a gas burner that has improved energy efficiency as compared to known gas burner constructions, and at the same time allows production and manufacture at comparatively low costs.

LIST OF REFERENCE NUMERALS

1 crown
2 crown body
3 bottom wall
4 circumferential wall
5 gas distribution chamber
6 grooves
7 outer surface
8 gas inlet port
9 groove base
10 upper outer edge
11 lower outer edge
12 groove perimeter
13 cap perimeter
14 cap
15 first level surface area
16 second level surface area
17 stepped edge
18 further crown
19 inner first crown
20 middle second crown
21 third outer crown

The invention claimed is:

1. Gas burner for a gas hob of a gas cooking appliance comprising:

a gas crown and a cap configured for covering the gas crown, wherein the crown comprises a gas distribution chamber confined by a circumferential wall which comprises a peripheral, slanted outer surface inclined between 20 and 70 degrees relative to a horizontal plane, an outer circumferential edge of the slanted outer surface defining an outer perimeter of the gas burner and a plurality of gas outlet ports implemented in the circumferential wall as upwardly opened grooves passing through the circumferential wall, wherein a base of each groove has an angle ranging from 10 to 30 degrees relative to the horizontal plane and the gas outlet ports open into the slanted outer surface, the gas crown being formed as a single-piece part, wherein lower outer edges of the grooves define a groove perimeter corresponding to or being larger than an outer perimeter of the cap, and the cap comprising a first horizontal, level surface area facing the gas crown and covering the grooves at an upper end of the gas crown, respective openings of the grooves extending through an upper portion of the slanted outer surface, the gas crown including a lower portion extending from the groove base of the grooves to a bottom of the gas crown wherein a length of the upper portion measured along the slanted outer surface is less than a length of the lower portion measured along the slanted outer surface and the lower portion of the slanted outer surface implements a closed truncated cone envelope.

2. Gas burner according to claim 1, wherein the slanted outer surface in lateral cross section of the circumferential wall has a homogenous, linear shape.

3. Gas burner according to claim 1, wherein the cap comprises a second level surface area which, in the assembled state, covers the distribution chamber, wherein the first and second surface areas are stepped relative to each other, and a stepped edge between the first and second surface areas in the assembled state faces an upper, inner perimeter of the circumferential wall.

4. Gas hob comprising at least one gas burner according to claim 1.

5. Gas cooking appliance comprising a gas hob according to claim 4.

6. Gas cooking appliance according to claim 5, wherein the slanted outer surface in lateral cross sections of the circumferential wall has a homogenous, linear shape.

7. Gas burner according to claim 5, wherein the cap comprises a second level surface area which, in the assembled state, covers the distribution chamber, wherein the first and second surface area are stepped relative to each other, and a stepped edge between the first and second surface areas in the assembled state faces an upper, inner perimeter of the circumferential wall.

8. Gas burner according to claim 5, wherein the crown has the shape of a truncated cone.

* * * * *